United States Patent [19]

Tsuchida et al.

[11] Patent Number: 4,512,313

[45] Date of Patent: Apr. 23, 1985

[54] ENGINE CONTROL SYSTEM HAVING EXHAUST GAS SENSOR

[75] Inventors: Tsuyoshi Tsuchida; Yoshinobu Kido; Hideki Kakumoto; Yuzuru Tanaka, all of Hiroshima, Japan

[73] Assignee: Mazda Motor Corporation, Hiroshima, Japan

[21] Appl. No.: 500,918

[22] Filed: Jun. 3, 1983

[30] Foreign Application Priority Data

Jun. 4, 1982 [JP] Japan ..... 57-96849
Jun. 4, 1982 [JP] Japan ..... 57-96848

[51] Int. Cl.[3] ..... F02M 7/12
[52] U.S. Cl. ..... 123/440; 123/489
[58] Field of Search ..... 123/440, 489

[56] References Cited

U.S. PATENT DOCUMENTS 3,938,075 2/1976 Reddy ..... 123/489 X
3,938,479 2/1976 Oberstadt ..... 123/489

FOREIGN PATENT DOCUMENTS 51-54132 5/1976 Japan .
53-112331 9/1978 Japan .

*Primary Examiner*—Tony M. Argenbright

*Attorney, Agent, or Firm*—Fleit, Jacobson, Cohn & Price

[57] ABSTRACT

An internal combustion engine including an intake system for providing a supply of intake gas to the engine, an exhaust system for exhausting combustion gas from the engine as exhaust gas and an engine control system. The engine control system includes an exhaust gas sensor provided in the exhaust system of the engine for producing an electric signal which corresponds to the concentration of a constituent in the engine exhaust gas, a regulating device for regulating at least one of factors which affects operating conditions of the engine, and a control circuit which includes a comparator for comparing the electric signal with a first reference value to produce a control signal, a discriminating circuit including an operation circuit for performing operations to obtain rate of change in a unit time of the electric signal and produce a sensor activated signal when the rate of change of the electric signal is greater than a second predetermined value and a signal holding circuit for holding the sensor activated signal until the engine is stopped, a gate circuit responsive to the sensor activated signal applied from the signal holding circuit and allowing to pass the control signal from the comparator to the regulating device to control the regulating device under the control signal.

5 Claims, 5 Drawing Figures

ENGINE CONTROL SYSTEM HAVING EXHAUST GAS SENSOR

The present invention relates to an engine control system and more particularly to an engine control system in which various controls are performed in accordance with concentrations of constitutents in engine exhaust gas.

Hithertofore, it has already been proposed in the field of automobile engines to detect concentrations of constituents in engine exhaust gas to control the air-fuel ratio of the combustible mixture supplied to the engine, the quantity of the combustion gas recirculated to the engine intake system and/or the supply of the secondary air which is supplied to the exhaust gas purifying system. For the purpose, engine exhaust systems have been provided with an exhaust gas sensor which functions to detect concentration of a constituent such as oxygen of the exhaust gas. It has been recognized in such an engine control system that the exhaust gas sensor does not become active until it is warmed-up to a certain temperature and it does not represent an accurate concentration when it is under a low temperature. Therefore, if the engine control is performed with the signals from the sensor of which temperature is not sufficiently high, an accurate and fully responsive control cannot be expected.

In view of the problems, there is proposed by the Japanese patent application No. 53-30262 which has been filed on June 5, 1973 and disclosed for public inspection on Sept. 30, 1978 under the disclosure No. 53-112331 to perform the control under the signals of the exhaust gas sensor only when the signals are above a predetermined level. The proposal is based on the fact that the electrical signals from the exhaust gas sensor are of very small values under low temperature conditions, and therefore the level of the signal is used to judge whether the sensor is in an active condition or not.

It should however be noted that the proposal is not satisfactory in accurately judging an active condition of the sensor and there is a possibility that the control is started even when the sensor is still in a semi-active condition. More specifically, the rate of temperature increase in the exhaust gas sensor after engine start depends largely on the engine operating conditions. For example, if the automobile equipped with the engine is immediately started to run after the engine start, the temperature of the sensor will be increased rapidly so that the level of the sensor output signal is also increased rapidly to bring the sensor to an active condition. On the other hand, if the engine is warmed-up with an idling speed, the temperature of the sensor will be increased slowly so that the sensor is maintained under a semi-active condition for a relatively long period. In such a semi-active condition, the signals from the exhaust gas sensor do not change quickly in response to a change in the concentration of a constituent in the exhaust gas so that a satisfactory engine control cannot be expected.

It is therefore an object of the present invention to provide an engine control system having an exhaust gas sensor for detecting concentration of a constituent in the exhaust gas, which has means for detecting accurately the active condition of the exhaust gas sensor.

Another object of the present invention is to provide an engine control system having an exhaust gas sensor, in which the engine control is performed when the exhaust gas sensor is in an active condition but the control is cut when the sensor is in inactive condition.

According to the present invention, the above and other objects can be accomplished by an internal combustion engine including an intake system for drawing fresh charge of intake gas to the engine, an exhaust system for exhausting combustion gas from the engine as an exhaust gas and an engine control system, said engine control system including exhaust gas sensing means provided in said exhaust system of the engine for producing an electric signal which corresponds to concentration of a constituent in the engine exhaust gas, regulating means for regulating at least one of factors which affects operating conditions of the engine, control means for receiving said electric signals from the sensing means to calculate rate of change in a unit time of said electric signal when the sensing means is being warmed-up and produce a control signal for controlling said regulating means after the rate of change of said electric signal has become greater than a predetermined value.

The present invention is based on the findings that the activeness of the exhaust gas sensing means is dependent largely on the rate of change of the outputs thereof rather than the output level. The exhaust gas sensing means may be an oxygen sensor made of zirconium oxide coated with plutinum catalyst.

According to a preferable mode of the present invention, the control means includes first means for calculating the rate of change in the electric signal from the sensing means in a first predetermined time period, second means for calculating the rate of change in the electric signal from the sensing means in a second predetermined time period which is longer than the first predetermined time period and means for producing the control signal when at least one of the rates of change in the first and second time period is greater than the predetermined value. This feature is effective to eliminate erroneous control due to signal noises and differences in properties among the sensors. In order to avoid an erroneous control due to signal noises, it is preferable to select the predetermined value at a relatively high level. For that purpose, it will become necessary to make the sampling time relatively long in view of the fact that there may be relatively less sensitive sensors. However, such a long sampling time will not be advantageous in case where the sensor is of a relatively sensitive one because there will be an undue delay in starting the control. The aforementioned feature of the present invention is advantageous in that such undue delay of starting the control can be avoided by providing two sampling time periods.

The above and other objects and features of the present invention will become apparent from the following descriptions of preferred embodiments taking reference to the accompanying drawings, in which.

Figure 1:
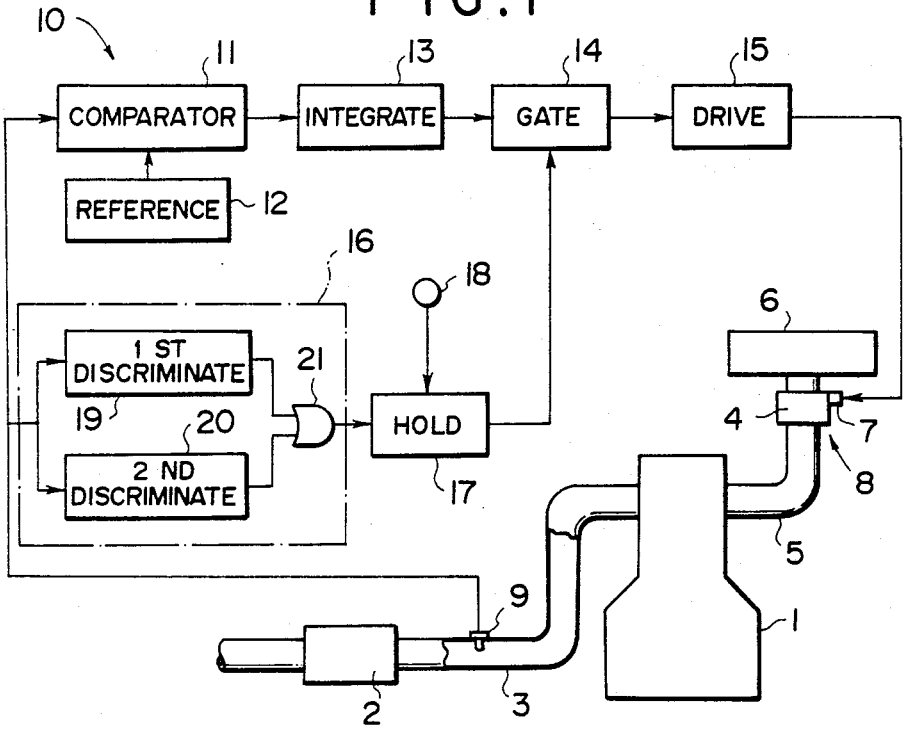
FIG. 1 is a diagrammatical illustration of the engine control system in accordance with one embodiment of the present invention.

Referring now to the drawings, particularly to FIG. 1, there is shown an internal combustion engine 1 having an exhaust passage 3 provided with a catalytic exhaust gas purifying device 2. The engine 1 also has an intake passage 5 provided with a carburetor 4 and an air cleaner 6 located upstream of the carburetor 4. Although not shown in FIG. 1, the intake passage 5 is provided with a throttle valve as well known in the art to control the quantity of the air introduced into the engine 1. The carburetor 4 has an actuator 7 which functions to regulate the air-fuel ratio of the mixture supplied to the engine 1. The carburetor 4 and the actuator 7 together constitute a regulating device 8 for regulating the air-fuel ratio. The actuator 7 may be a solenoid valve which controls the quantity of bleed air drawn through the carburetor 4 to the intake passage 5.

In the exhaust passage 3, there is an oxygen sensor 9 upstream of the catalytic device 2 for detecting the oxygen concentration in the engine exhaust gas. The oxygen sensor 9 produces an electric signal corresponding to the oxygen concentration and the signal is transmitted to a control circuit 10 which functions to produce a control signal for controlling the operation of the actuator 7 of the regulating device 8 to regulate the air-fuel ratio of the mixture in accordance with the signal from the oxygen sensor 9.

The control circuit 10 includes a comparator 11 which receives the electric signal from the oxygen sensor 9. A reference circuit 12 is provided for supplying a reference voltage to the comparator 11. The comparator 11 functions to compare the signal from the sensor 9 with the reference voltage from the circuit 12 and produce a differential signal which is applied to an interating circuit 13. The circuit 13 has an output connected with a gate circuit 14 which is in turn connected with a driving circuit 15. The driving circuit 15 produces a control signal which is applied to the actuator 7 to energize the same.

The gate circuit 14 is connected so as to be controlled by the output of an activeness discriminating circuit 16. For the purpose, there is provided a hold circuit 17 which receives the output from the circuit 16 and applies an output to the gate circuit 14 to thereby control the operation of the gate circuit 14. The hold circuit 17 receives a signal from the engine ignition switch 18 and functions to hold the signal from the discriminating circuit 16 to continuously apply the signal to the gate circuit 14 to open the same. The hold circuit 17 terminates its operation when the ignition switch 18 is turned off to stop the engine.

Figure 2:
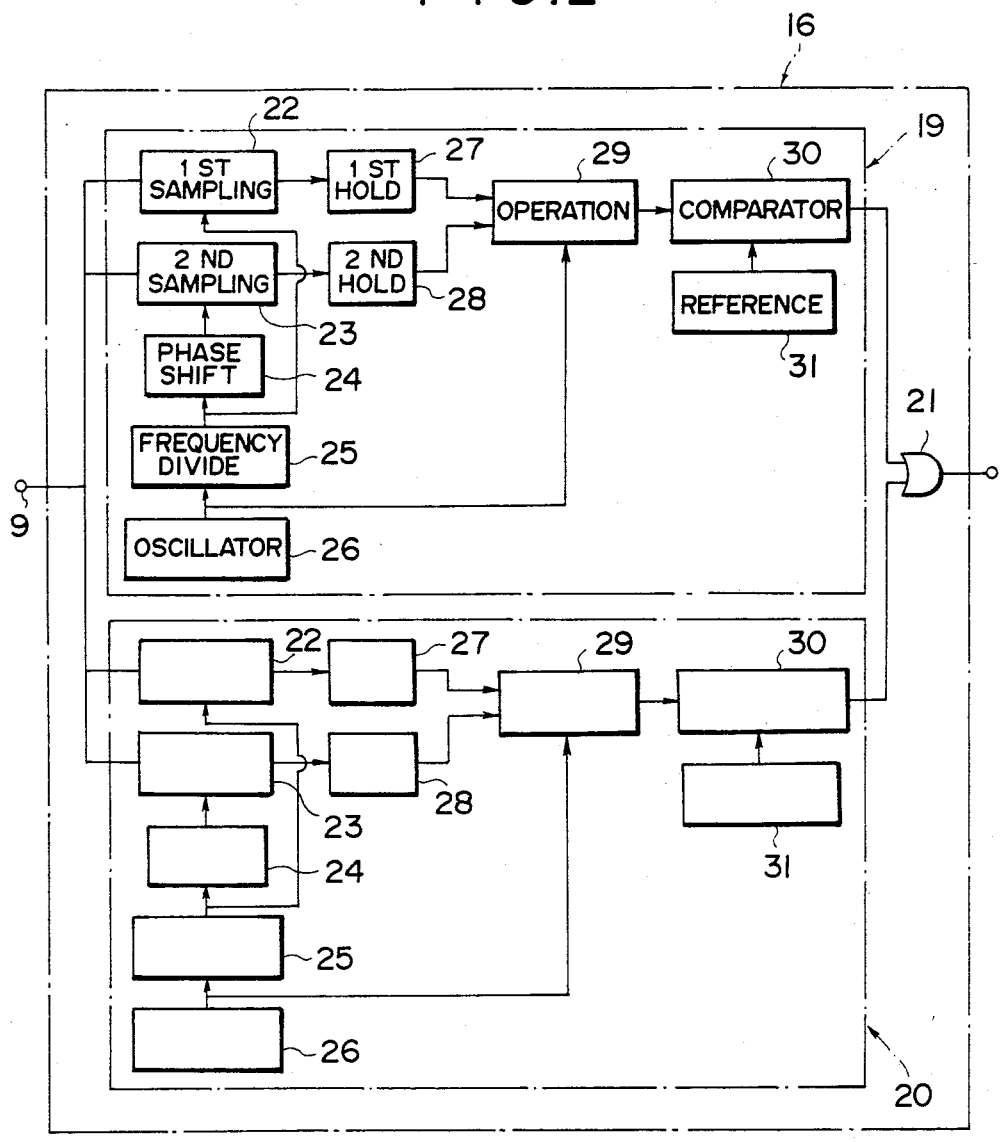
FIG. 2 is a block diagram showing details of the activeness discriminating circuit in the control system.

Referring to FIG. 2, it will be noted that the discriminating circuit 16 includes a first discriminating section 19 and a second discriminating section 20. The first and second sections are similar in arrangement so that corresponding parts are designated by the same reference numerals and descriptions will be made mainly with respect to the first section 19. The first section 19 includes a first sampling circuit 22 and a second sampling circuit 23 which are connected so as to receive the electric signals from the sensor 9. An oscillating circuit 26 is provided to produce timing pulses with predetermined time intervals, for example, of 0.5 second, as shown by (a) in FIG. 4. The timing pulses from the oscillating circuit 26 are applied to a frequency dividing circuit 25 so that the frequency of the pulses are reduced to one-half of the frequency of the timing pulses from the circuit 26 as shown by (b) in FIG. 4. The output of the circuit 25 is on one hand applied directly to the first sampling circuit 22 and on the other hand to a phase shifting circuit 24 which functions to make the pulses from the circuit 25 to delay for a predetermined time, for example, 0.5 second, as shown by (c) in FIG. 4. The output of the circuit 24 is then applied to the second sampling circuit 23.

The first and second sampling circuits 22 and 23 functions to sample the signals from the sensor 9 when the pulses are received from the circuits 25 and 24, respectively, and apply the signals to a first and second holding circuits 27 and 28, respectively. The hold circuits 27 and 28 hold the signals from the sampling circuits 22 and 23, respectively, and apply the signals to an operation circuit 29. The operation circuit 29 is arranged so that it receives the timing pulses from the oscillating circuit 26 and performs an operation to obtain the difference between the signals from the hold circuits 27 and 28. Thus, the operation circuit 29 produces a signal corresponding to the rate of change of the signal from the sensor 9 in a first predetermined time period, for example, 0.5 second. The output from the operation circuit 29 is applied to a comparator 30 which also receives a reference signal from a reference circuit 31. The comparator 30 functions to compare the signal from the operation circuit 29 with the reference signal from the circuit 31 and produces an output when the signal from the operation circuit 29 is greater than the reference signal.

Figure 4:
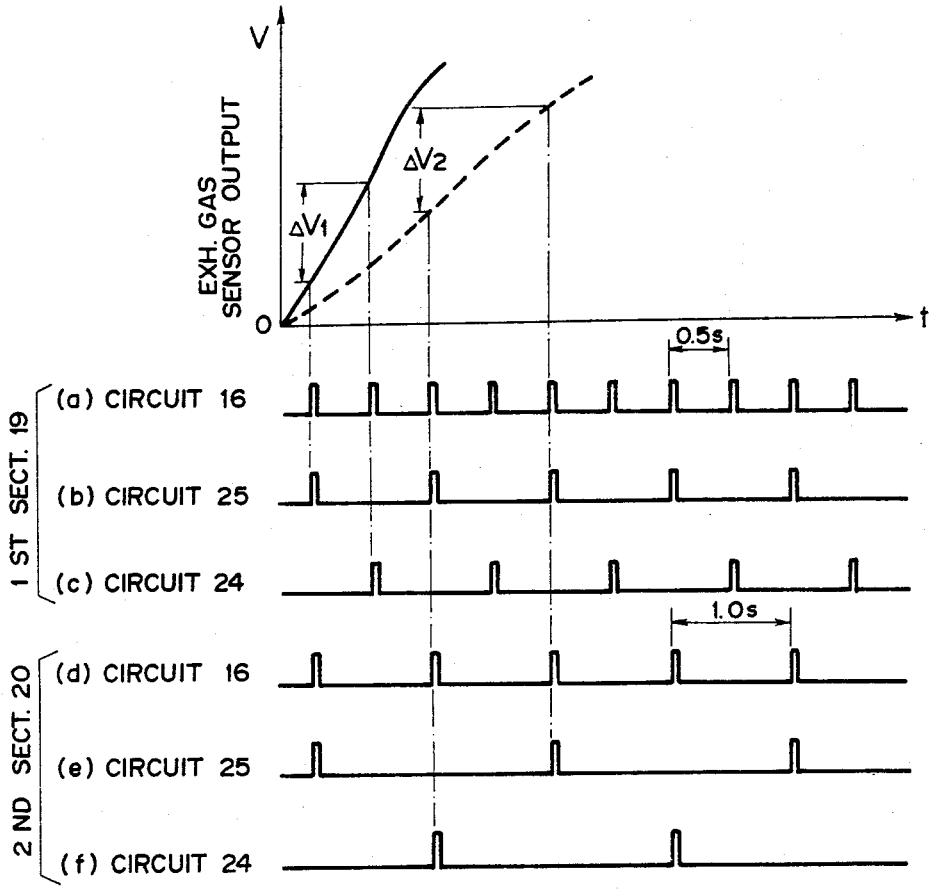
FIG. 4 is a time chart showing the sampling timings in the circuit shown in FIG. 2; and, FIG. 5 is a flow chart showing the functions in the control system.

In the second discriminating section 20, the oscillating circuit 26 produces timing pulses of which time intervals are greater than those of the pulses from the circuit 26 in the first section 19, as shown by (d) in FIG. 4. For example, the time interval between the pulses from the circuit 26 in the second section may be 1.0 second. Thus, the output pulses are produced from the frequency dividing circuit 25 with a time interval of, for example, 2.0 second, as shown by (e) in FIG. 4. The phase shifting circuit 24 gives the pulses from the circuit 25 with a delay of for example 1.0 second, as shown by (f) in FIG. 4. Therefore, the operation circuit 29 calculates the change in the signal from the sensor 9 in a time period, for example, 1.0 second which is longer than the time period in which the signal change is calculated in the first section. The reference signal from the reference circuit 31 in the second section 20 may not be the same as that in the first section 19. In any event, the reference signal is determined taking into consideration the minimum value of the change in the signal from the exhaust gas sensor 9 when the sensor 9 is in the active condition. Further, the reference signal must be sufficiently high so that any influence of noise can be avoided. The outputs from the comparators 30 in the first and second sections 19 and 20, respectively, are applied to an OR gate 21 of which output is connected with the hold circuit 17.

Figure 3:
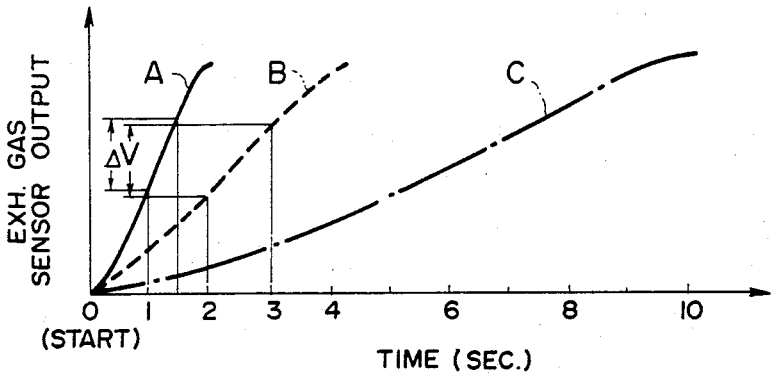
FIG. 3 is a diagram showing examples of changes in the exhaust gas sensor outputs after engine start.

Referring to FIG. 3, the curves A and B show increases in the outputs of the exhaust gas sensors having different properties in cases where the sensors are warmed-up rapidly by, for example, running the automobile equipped with the engine in question immediately after the engine start. The curve C shows an output increase when the sensor is warmed-up relatively slowly by, for example, maintaining the engine in idling operation. The value $\Delta V$ is determined by either of the reference signals from the circuits 31. When the signal increase in the first time interval as determined by the first section 19 exceed the reference voltage as in the case shown by the curve A, an output is produced from the first section 19 to open the OR gate 21. In this case, the signal increase in the second time interval as determined by the second section 20 will also exceed the reference voltage from the reference circuit 31. When the property of the sensor 9 is such that the output increase is relatively moderate as shown by the curve B in FIG. 3, the signal increase in the first time interval will not exceed the reference voltage but that in the second time interval will exceed the reference voltage. Thus, an output will be produced in the second section 20 to open the OR gate 21. When the signal increase is very slow as shown by the curve C in FIG. 3, output is not produced in both of the first and second sections 19 and 20. Once the output is applied from the discriminating circuit 16 to the hold circuit 17, the hold circuit 17 continues to apply the output to the gate circuit 14 to maintain the gate circuit 14 in the open state. Thus, the signal from the comparator 11 is applied to the intergrating circuit 13 and then passed through the gate circuit 14 to the driving circuit 15.

Figure 5:
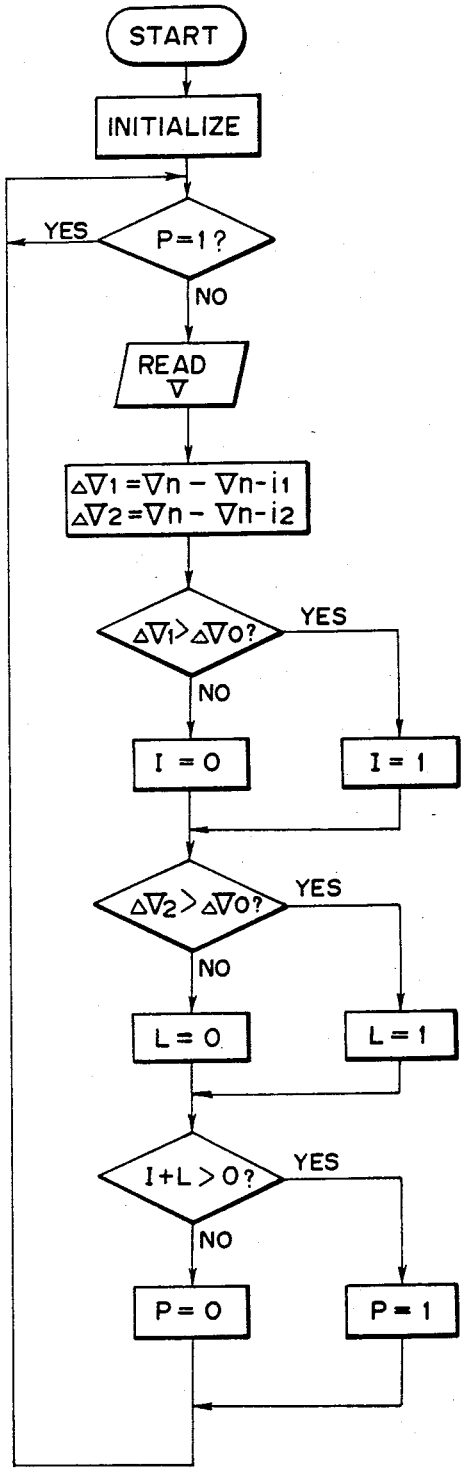

The discriminating circuit 16 and the hold circuit 17 may be substituted by a microcomputer with a suitable programming. FIG. 5 shows a control flow chart of such programming. In operation, the computer is at first initialized to set the exhaust gas activated signal P, the first discriminating signal I and the second discriminating signal L to zero. Then, the control procedure is proceeded by the first step in which the activated signal P is 1 or 0. When the signal P is 1, is it judged that the sensor 9 is in the active condition and the checking procedure is terminated. When the signal P is 0, it is judged that the sensor 9 is not in the active condition and the voltage signal V from the sensor 9 is read. The voltage signal V is read in predetermined time intervals and the change of the voltage signal V in a first predetermined time interval and that in a second predetermined time interval are calculated as the signal changes $\Delta V_1$ and $\Delta V_2$, respectively. The first signal change $\Delta V_1$ is then compared with a reference voltage $\Delta V_0$ and, if the $\Delta V_1$ is greater than $\Delta V_0$, the first discriminating signal I is turned to 1 but when the $\Delta V_1$ is smaller than $\Delta V_0$, the signal I is maintained at 0. Thereafter, the second signal change $\Delta V_2$ is compared with the reference voltage $\Delta V_0$ and, if the signal change $\Delta V_2$ is greater than the voltage $\Delta V_0$, the second discriminating signal L is turned to 1 but, when the $\Delta V_2$ is smaller than $\Delta V_0$, the signal L is maintained at 0. Then, when either one or both of the signals I and L are not 0, the activated signal P is turned to 1 but, when both of the signals I and L are 0, the signal P is maintained at 0. The high level signal P may be applied to the gate circuit 14 to open the same so that the signal from the comparator 11 is passed through the integrating circuit 13 and the gate circuit 14 to the driving circuit 15. It is of course possible to have the functions of the comparator 11, the integrating circuit 13 and the gate circuit 14 performed by the same or a different microcomputer.

The control system is not limited to the control of the air-fuel ratio of the mixture as illustrated but it can well be applied to a control of any other factor which has an influence on the operation of the engine. For example, it can also be used to a control of exhaust gas recirculation or of the secondary air supply to the exhaust gas purifying system.

The invention has thus been shown and described with reference to specific embodiments, however, it should be noted that the invention is in no way limited to the details of the illustrated arrangements but changes and modifications may be made without departing from the scope of the appended claims.

We claim:

1. An internal combustion engine including an intake system for drawing fresh charge of intake gas to the engine, an exhaust system for exhausting combustion gas from the engine as an exhaust gas, and an engine control system, said engine control system including exhaust gas sensing means provided in said exhaust system of the engine for producing an electric signal which corresponds to concentration of a constituent in the engine exhaust gas, regulating means for regulating at least one factor which affects operating conditions of the engine, control means for receiving said electric signals from the sensing means to calculate rate of change in a unit time of said electric signal when the sensing means is being warmed-up and produce a control signal for controlling said regulating means after the rate of change of said electric signal has become greater than a predetermined value, said control means including means for producing a sensor activated signal when the rate of change of said electric signal exceeds the predetermined value, and signal hold means for maintaining the sensor activated signal until the engine is stopped so that the control signal is produced even when the rate of change is decreased.

2. An engine in accordance with claim 1 in which said regulating means is means for regulating air-fuel ratio of mixture supplied to the engine.

3. An internal combustion engine including an intake system for providing a supply of intake gas to the engine, an exhaust system for exhausting combustion gas from the engine as exhaust gas and an engine control system, said engine control system including exhaust gas sensing means provided in said exhaust system of the engine for producing an electric signal which corresponds to concentration of a constituent in the engine exhaust gas, regulating means for regulating at least one of factors which affects operating conditions of the engine, control circuit means which includes means for comparing said electric signal with a first reference value to produce a control signal, discriminating means including means for performing operations to obtain rate of change in a unit time of said electric signal and produce a sensor activated signal when the rate of change of the electric signal is greater than a second predetermined value and signal holding means for holding the sensor activated signal until the engine is stopped, means responsive to the sensor activated signal applied from the signal holding means and allowing to pass the control signal from the comparing means to said regulating means to control the regulating means under the control signal.

4. An internal combustion engine including an intake system for providing a supply of intake gas to the engine, an exhaust system for exhausting combustion gas from the engine as exhaust gas and an engine control system, said engine control system including exhaust gas sensing means provided in said exhaust system of the engine for producing an electric signal which corresponds to concentration of a constituent in the engine exhaust gas, regulating means for regulating at least one of factors which affects operating conditions of the engine, control circuit means which includes means for comparing said electric signal with a first reference value to produce a control signal, first discriminating means including means for performing operations to obtain rate of change, in a first unit time, of said electric signal and produce a sensor activated signal when the rate of change of the electric signal is greater than a second predetermined value, second discriminating means including means for performing operations to obtain rate of change, in a second unit time which is greater than the first unit time, of said electric signal and produce a sensor activated signal when the rate of change of the electric signal is greater than a third predetermined value, and signal holding means for holding the sensor activated signal once at the sensor activated signal is produced by at least one of the first and second discriminating means until the engine is stopped, means responsive to the sensor activated signal applied from the signal holding means and allowing to pass the control signal from the comparing means to said regulating means to control the regulating means under the control signal.

5. An internal combustion engine including an intake system for drawing fresh charge of intake gas to the engine, an exhaust system for exhausting combustion gas from the engine as an exhaust gas, and an engine control system, said engine control system including exhaust gas sensing means provided in said exhaust system of the engine for producing an electric signal which corresponds to concentration of a constituent in the engine exhaust gas, regulating means for regulating at least one factor which affects operating conditions of the engine, control means for receiving said electric signals from the sensing means to calculate rate of change in a unit time of said electric signal when the sensing means is being warmed-up and produce a control signal for controlling said reulgating means after the rate of change of said electric signal has become greater than a predetermined value, said control means including first means for calculating the rate of change in the electric signal from the sensing means in a first predetermined time period, second means for calculating the rate of change in the electric signal from the sensing means in a second predetermined time period which is longer than the first predetermined time period and means for producing the control signal when at least one of the rates of change in the first and second time period is greater than the predetermined value.

* * * * *